United States Patent [19]

Hoffman

[11] 3,967,805

[45] July 6, 1976

[54] CURTAIN ROD SUPPORT ASSEMBLY

[75] Inventor: Robert Hoffman, Chicago, Ill.

[73] Assignee: Lawrence Peska Associates, Inc., New York, N.Y. ; a part interest

[22] Filed: Mar. 12, 1975

[21] Appl. No.: 557,770

[52] U.S. Cl. ..... 248/262; 248/222

[51] Int. Cl.[2] ..... A47H 1/10; A47H 5/14

[58] Field of Search ..... 248/261, 262, 263, 265, 248/252, 254, 255, 256, 257, 258, 259, 260, 222

[56] References Cited

UNITED STATES PATENTS

| | | | |
|---|---|---|---|
| 150,230 | 4/1874 | Dobbs | 248/222 X |
| 924,892 | 6/1909 | Datter | 248/255 X |
| 1,381,606 | 6/1921 | Weresiuk | 248/255 |
| 1,903,728 | 4/1933 | Firestone | 248/256 |
| 2,459,503 | 1/1949 | Dahlstrom et al. | 248/262 |

*Primary Examiner*—J. Franklin Foss

*Attorney, Agent, or Firm*—Richard E. Nanfeldt

[57] ABSTRACT

A curtain rod support assembly is used to support a cylindrical curtain rod in a horizontal plane, wherein a curtain is suspended vertically downward from the curtain rod. A support assembly communicates with each end of the curtain rod. The support assembly broadly consists of a support bracket affixed onto a vertical wall, wherein the end of the curtain rod communicates with the support bracket. An anchoring device communicates with the support bracket as well as ceiling and the vertical wall.

3 Claims, 2 Drawing Figures

CURTAIN ROD SUPPORT ASSEMBLY

SUMMARY OF THE INVENTION

My invention relates to a unique and novel curtain rod support assembly used to maintain a curtain or drapery rod in a horizontal plane.

An object of my present invention is to provide a means for supporting a curtain rod in a horizontal plane, wherein the support assembly is firmly anchored into both a ceiling and a vertical wall; thus, the conventional problem of the bracket pulling away from the vertical wall is eliminated.

A further object of my present invention is to provide a curtain rod support assembly of simple design and low manufacturing cost.

Briefly, my present invention comprises a support assembly communicating with each end of the curtain rod. The support assembly broadly consists of a pair of support brackets affixed onto a vertical wall, wherein each end of the curtain rod communicates with the support brackets. Anchoring devices communicates with each support bracket, as well as a ceiling and the vertical wall.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 2:
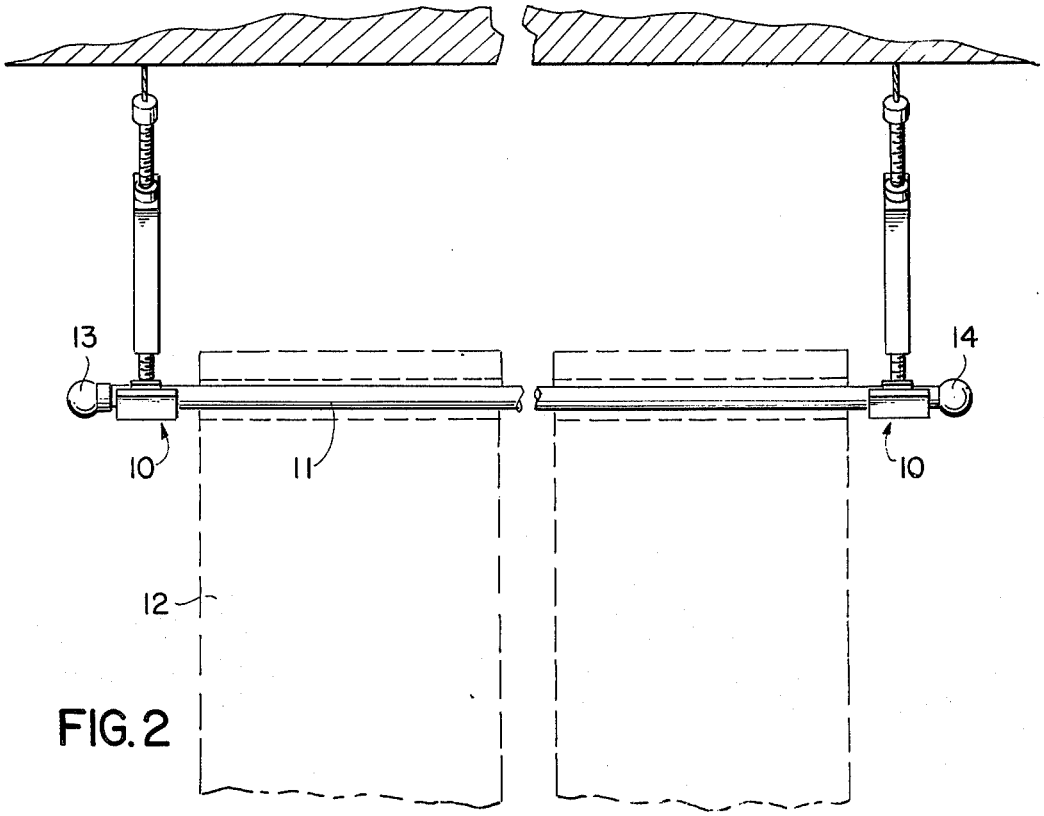
FIG. 2 illustrates a front view of a curtain support assembly.

Turning now descriptively to the drawings, in which similar reference characters denote similar elements throughout the several views, FIG. 2 shows a curtain rod support assembly 10 used to support a cylindrical curtain rod 11 in a horizontal plane, wherein a curtain 12 is suspended vertically downward from the horizontal curtain rod 11. The curtain rod 11 is supported at each of its ends 13, 14 by one individual curtain rod support assembly 10.

Figure 1:
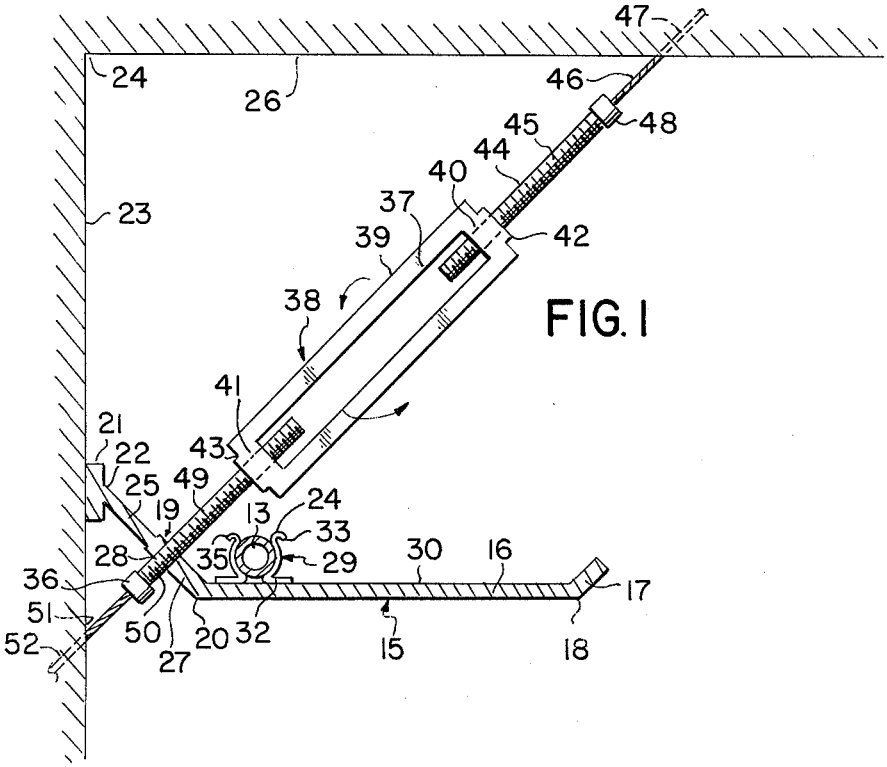
FIG. 1 illustrates an end view of a curtain support assembly.

FIG. 1 shows an individual curtain rod support assembly 10 generally consisting of a support bracket 15 and a means of supporting the support bracket 15. Each support bracket 15 has a central horizontal portion 16 having an upward extending lip flange 17 at an obtuse angle to the first end 18 thereof. A two sectional telescopic rod assembly 19 extends vertically upward at an obtuse angle from a second end 20 of portion 16, wherein a vertical support block member 21 is affixed onto a free end 22 of the outer section 25 of assembly 19. The block member 21 is anchored onto a vertical wall 23 at a point below the juncture 24 of the vertical wall 23 and the ceiling 26. Depending upon the vertical placement of block member 21 on wall 23 and the extension of leg assembly 19, the horizontal portion 16 of bracket 15 can be adjusted relative to the wall 23 and ceiling 26. The inner section 27 of leg assembly 19 has an opening 28 therethrough, wherein opening 28 is beveled at a 45° relative to a horizontal plane. A spring clamp assembly 29 is affixed onto a top surface 30 of the horizontal portion 16 of each bracket 15, wherein the ends 13, 14 of the curtain rod 11 snap into each spring clamp assembly 29. Each spring clamp assembly 29 consist of a bottom mounting plate 31 having two upward extending complementary legs 32, 33 wherein legs 32, 33 are of a generally concave curvative having outwardly turned top horizontal flanges 34, 35. The cylindrical curtain rod 11 engages the interior concave faces of legs 32, 33. The means of supporting each support bracket 15 consists of an anchoring device 38. The anchoring device comprises a cylindrical shaped turnbuckle 39 having internal threaded surfaces 40, 41 at each outer end 42, 43 thereof. A first cylindrical rod 44 having a first threaded outer surface 45 threadably communicates with the first internal threaded surface 40 of the first end 42 of turnbuckle 39. A first nail member 46 having a threaded outside surface 47 communicates with a free end 48 of the first cylindrical rod 44, wherein nail member 46 is a linear extension of rod 44. A second cylindrical rod 49 having a second threaded outer surface 50 threadably communicates with the second internal threaded surface 41 of the second end 43 of turnbuckle 39. A second nail member 51 having a threaded outside surface 52 communicates with an outer end 36 of the second cylindrical rod 49, wherein nail member 51 is a linear extension of rod 49. The turnbuckle 39 has a knurled outer surface 37.

In use, the second rod 49 extends through opening 28 of support bracket 15, wherein rod 49 threadably engages an interior threaded surface 55 of opening 28. The second nail member 51 is embedded into the vertical wall 23 at an acute downward angle and the first nail member 46 is embedded into the ceiling 26 at an acute angle relative to a vertical plane. As turnbuckle 39 is rotated, rods 44, 49 extend further outward from the ends 42, 43 of the turnbuckle causing the nail members 46, 51 to be further embedded into the wall 23 and ceiling 26.

Hence, obvious changes may be made in the specific embodiment of the invention described herein, such modifications being without the spirit and scope of the invention claimed, it is indicated that all matter contained herein is intended as an illustrative and not as limiting in scope.

Having thus described the invention, what I claim as new and desire to secure by Letters Patent of the United States is:

1. A curtain rod support assembly for maintaining a curtain rod in a horizontal plane, which comprises:

a. support brackets affixed onto a vertical wall, each said support bracket including a central horizontal portion, an upwardly extending lip flange joined at an obtuse angle to a first end of said horizontal portion, a two sectional telescopic rod assembly extending upwardly at an obtuse angle from a second end of said horizontal portion, said rod assembly consisting of an inner and an outer section joined to said second end of said horizontal portion, a vertical support block member joined to a free end of said outer section, said vertical support block member affixed onto said vertical wall, said inner section having a beveled opening therethrough, said beveled opening having a threaded interior surface;

b. an anchoring device communicating with each support bracket as well as said vertical wall and a ceiling; and c. each end of said curtain rod communicating with one said support bracket.

2. A curtain rod support assembly as recited in claim 1, wherein each said bracket support assembly further comprises a spring clamp assembly joined onto a top surface of said central horizontal portion, wherein said end of said curtain rod communicates with said spring clamp assembly.

3. A curtain rod support assembly as recited in claim 2, wherein said anchoring device comprises:

a. a cylindrical turnbuckle having internal threaded surfaces at each end thereof;

b. a first cylindrical rod having a first threaded outer surface threadably engaging one said internal threaded surface of said turnbuckle;

c. a first nail member having a first threaded outside surface joined onto a free end of said first cylindrical rod;

d. a second cylindrical rod having a second threaded outer surface threadably engaging another said internal threaded surface of said turnbuckle;

e. a second nail member having a second threaded outside surface joined onto a free end of second cylindrical rod;

f. said second cylindrical rod threadably engaging said opening of said support bracket;

g. said second nail member embedded in said vertical wall; and h. said first nail member embedded in said ceiling.

* * * * *